US011577313B2

(12) United States Patent
Kwon

(10) Patent No.: US 11,577,313 B2
(45) Date of Patent: *Feb. 14, 2023

(54) METHOD OF PREPARING COMPOSITE MATERIAL FOR HIGHLY HEAT-DISSIPATIVE AND DURABLE ELECTRIC WIRING CONNECTOR, AND COMPOSITE MATERIAL FOR ELECTRIC WIRING CONNECTOR PREPARED THEREBY

(71) Applicant: PUKYONG NATIONAL UNIVERSITY INDUSTRY—UNIVERSITY COOPERATION FOUNDATION, Busan (KR)

(72) Inventor: Hansang Kwon, Busan (KR)

(73) Assignee: Pukyong National University Industry-University Cooperation Foundation, Busan (KR)

( * ) Notice: Subject to any disclaimer, the term of this patent is extended or adjusted under 35 U.S.C. 154(b) by 318 days.

This patent is subject to a terminal disclaimer.

(21) Appl. No.: 16/909,539

(22) Filed: Jun. 23, 2020

(65) Prior Publication Data

US 2021/0323059 A1 Oct. 21, 2021

(30) Foreign Application Priority Data

Apr. 17, 2020 (KR) ..... 10-2020-0046859

(51) Int. Cl.
*B22F 3/105* (2006.01)
*H01R 13/629* (2006.01)
*H01R 31/08* (2006.01)

(52) U.S. Cl.
CPC ..... *B22F 3/105* (2013.01); *H01R 13/629* (2013.01); *H01R 31/08* (2013.01);
(Continued)

(58) Field of Classification Search
CPC ..... C08L 33/06–33/12
See application file for complete search history.

(56) References Cited

U.S. PATENT DOCUMENTS

2011/0017501 A1* 1/2011 Ohmi ..... H05K 1/0373 428/323
2017/0050159 A1* 2/2017 Xu ..... B01J 2/006
(Continued)

FOREIGN PATENT DOCUMENTS

JP 4313297 B2 8/2009
KR 10-2008-0054942 A 6/2008
(Continued)

OTHER PUBLICATIONS

WO-2014002581-A1 English language translation (Year: 2014).*
(Continued)

*Primary Examiner* — Anthony J Zimmer
*Assistant Examiner* — Sean P. O'Keefe
(74) *Attorney, Agent, or Firm* — Knobbe Martens Olson & Bear LLP

(57) ABSTRACT

This application relates to a method of preparing a composite material for an electric wiring connector. In one embodiment, the method includes preparing a powder mixture including (i) a metal powder composed of aluminum or aluminum alloy particles and magnesium particles and (ii) a polymer powder. The method may also include sintering the powder mixture to produce a composite material for the electric wiring connector using a spark plasma sintering (SPS) process. This application also relates to a composite material for an electric wiring connector prepared through the method described above. This application further relates to a method of manufacturing an electric wiring connector, the method including forming a housing of the electric wiring connector with the composite material. This appli-
(Continued)

cation further relates to an electric wiring connector manufactured by the method.

6 Claims, 3 Drawing Sheets

(52) U.S. Cl.
CPC . *B22F 2003/1051* (2013.01); *B22F 2301/052* (2013.01); *B22F 2301/058* (2013.01)

(56) References Cited

U.S. PATENT DOCUMENTS

| | | | | |
|---|---|---|---|---|
| 2020/0308465 | A1* | 10/2020 | Zhang | C08G 69/14 |
| 2021/0008616 | A1* | 1/2021 | Kwon | B29C 43/006 |
| 2021/0325449 | A1* | 10/2021 | Kwon | C22C 32/0036 |

FOREIGN PATENT DOCUMENTS

| | | | | |
|---|---|---|---|---|
| KR | 10-1515584 | B1 | 5/2015 | |
| KR | 10-2016-01134992 | A | 9/2016 | |
| WO | WO-2014002581 | A1 * | 1/2014 | C08J 5/042 |
| WO | WO-2016063591 | A1 * | 4/2016 | B22F 3/02 |

OTHER PUBLICATIONS

Park, Kwangjae, Jehong Park, and Hansang Kwon. "Effect of intermetallic compound on the Al—Mg composite materials fabricated by mechanical ball milling and spark plasma sintering." Journal of Alloys and Compounds 739 (2018): 311-318. (Year: 2018).*

* cited by examiner

METHOD OF PREPARING COMPOSITE MATERIAL FOR HIGHLY HEAT-DISSIPATIVE AND DURABLE ELECTRIC WIRING CONNECTOR, AND COMPOSITE MATERIAL FOR ELECTRIC WIRING CONNECTOR PREPARED THEREBY

CROSS REFERENCE TO RELATED APPLICATION

The present application claims priority to Korean Patent Application No. 10-2020-0046859, filed Apr. 17, 2020, the entire contents of which is incorporated herein for all purposes by this reference.

BACKGROUND

1. Field

The described technology relates to a method of preparing a composite material that is highly heat-dissipative and dielectric and is thus suitably used a material for a housing of an electric wiring connector, and to a composite material for an electric wiring connector, which is prepared through the method.

2. Description of the Related Technology

Most electronic devices and automobiles have very diverse and complex electrical interconnects.

A connector is a component that efficiently connects and couples electric wirings, and is one of the absolutely necessary components in electric and electronic equipment and transportation equipment. Connectors with various shapes and structures are used in various applications (refer to FIG. 1).

In recent years, electrification has been rapidly progressed and thus a lot of loads are placed on devices for electric wiring. Particularly, in the case of existing polymer-based connectors being excellent in electrical insulation ability, there is a high risk of fires due to their poor heat dissipation. Therefore, there is demand for new materials for connectors for electric wiring.

SUMMARY

An objective of the present invention is to provide a method of preparing a composite material that can be used as a material for a housing of an electric wiring connector because of excellent heat dissipation and insulation properties, and to provide a composite material for an electric wiring connector prepared thereby.

In order to accomplish one objective of the present invention, according to one aspect, there is provided a method of preparing a composite material for an electric wiring connector, the method including: (a) preparing a powder mixture including (i) a metal powder composed of magnesium particles and aluminum or aluminum alloy particles and (ii) a polymer powder; and (b) sintering the powder mixture to produce a composite material using a spark plasma sintering process.

The composite material prepared by the method according to the present invention may be a functionally graded composite material. The functionally graded composite material may be prepared by a method including: (a) preparing two or more powder mixtures, each powder mixture including (i) a metal powder composed of magnesium particles and aluminum or aluminum alloy particles and (ii) a polymer powder, in which a fraction ratio of the polymer in each powder mixture differs; (b) preparing a functionally graded laminate by sequentially laminating a plurality of powder mixture layers in which a content ratio of the polymer power with respect to the metal powder gradually varies from the bottom powder mixture layer to the top powder mixture layer; and (c) sintering the functionally graded laminate to produce the functionally graded composite material using a spark plasma sintering process.

In the functionally graded laminate, the content ratio of the polymer powder with respect to the metal powder may gradually increase or decrease from the bottom powder mixture layer to the top powder mixture layer.

In the powder mixture, a volume fraction of the metal powder composed of aluminum or aluminum alloy particles and magnesium particles may range from 14% to 45% and a volume fraction of the polymer powder may range from 55% to 85%.

In the metal powder, the aluminum or aluminum alloy particles and the magnesium particles may be contained at a volume fraction ratio of 1:1.

The polymer powder may be made from polyarylate (PAR).

The powder mixture may further contain a ceramic powder.

The ceramic powder may be made of one or more materials selected from the group consisting of MgO, $SiO_2$, $Al_2O_3$, AlN, $Si_3N_4$.

According to another aspect, there is provided a composite material for an electric wiring connector, the composite material being prepared by the method according to one aspect of the present invention.

The composite material according to the present aspect may be functionally graded. The functionally graded composite material may be formed into a sheet and configured such that a volume fraction of the polymer powder or the ceramic powder gradually changes from one side to the other in at least one direction selected from among a thickness direction, a lengthwise direction, and a widthwise direction.

According to a further aspect of the present invention, there is provided a method of manufacturing an electric wiring connector, the method including a step of forming a connector housing made of the composite material.

According to a yet further aspect, there is provided an electric wiring connector manufactured by the method according to one aspect of the present invention.

According to the present invention, the method of manufacturing a composite material for an electric wiring connector involves a step of performing spark plasma sintering on a powder mixture composed of an insulating polymer powder and a metal powder that contains aluminum or aluminum alloy particles and magnesium particles. Therefore, it is possible to obtain a material for an electric wiring connector that is highly heat-dissipative and durable with the use of the composite material.

In addition, the electrical wiring connector made of the metal-matrix polymer composite manufactured by the preparation method according to the present invention has a high dielectric constant corresponding to a specific resistivity of $10^6$ Ω·m or higher and a high heat dissipation property. Therefore, the electric wiring connector can efficiently dissipate heat even when it is used for a high-voltage wire for a long period time. That is, safety and lifespan of the electric wiring connector are improved.

DETAILED DESCRIPTION

Figure 1:
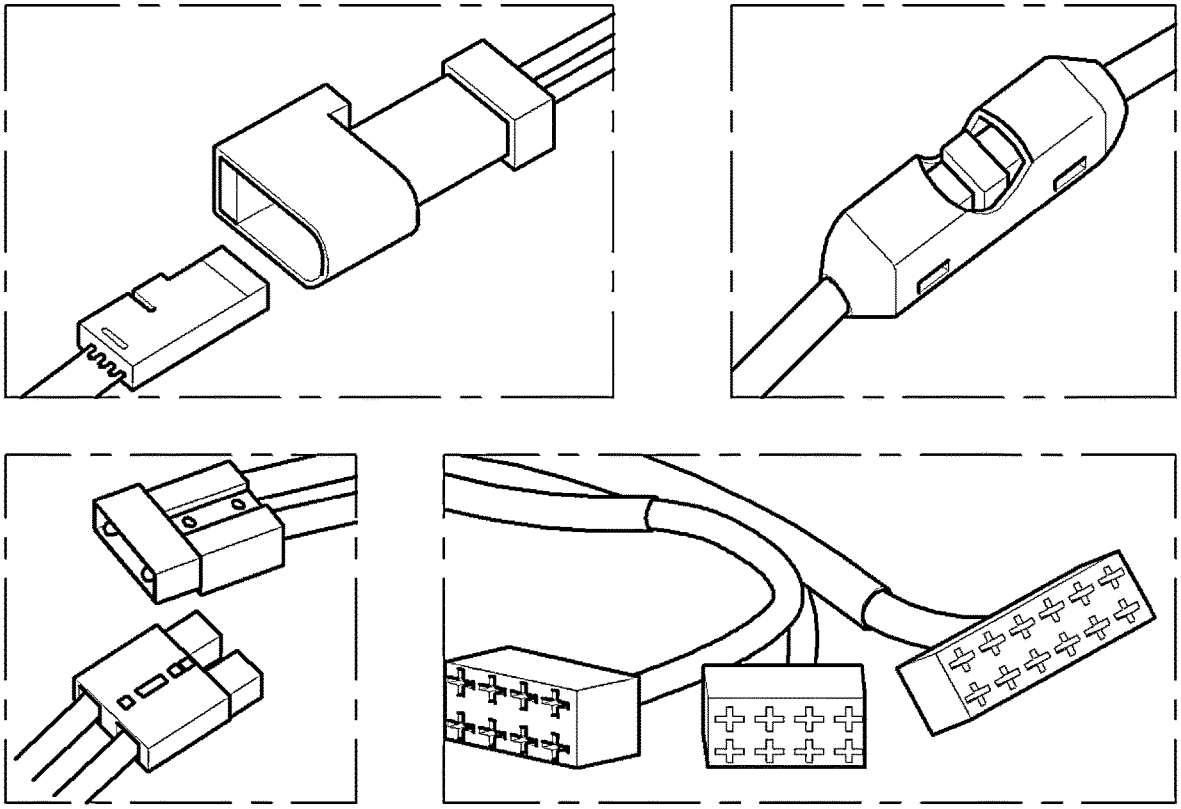
FIG. 1 includes photographs showing different types of electric wiring connectors.

In describing exemplary embodiments of the present invention, well-known functions or constructions will not be described in detail since they may unnecessarily obscure the understanding of the present invention.

Specific embodiments according to the concept of the present invention can be modified and changed in various ways to have various forms. Thus, only some specific embodiments are illustrated and described in the drawings and the description given below. However, it should be understood that all possible embodiments according to the concept of the present invention are not limited only to the specific embodiments disclosed herein but encompass all modifications, equivalents, and substitutes which fall within the spirit and technical scope of the claimed invention.

The terminology used herein is for the purpose of describing specific embodiments only and is not intended to limit the claimed invention. As used herein, the singular forms "a", "an", and "the" are intended to include plural forms as well unless the context clearly indicates otherwise. It will be further understood that the terms "comprises", "includes", or "has" when used in the present disclosure specify the presence of stated features, regions, integers, steps, operations, elements and/or components, but do not preclude the presence or addition of one or more other features, regions, integers, steps, operations, elements, components and/or combinations thereof.

Hereinafter, the present invention will be described in detail.

Figure 2:
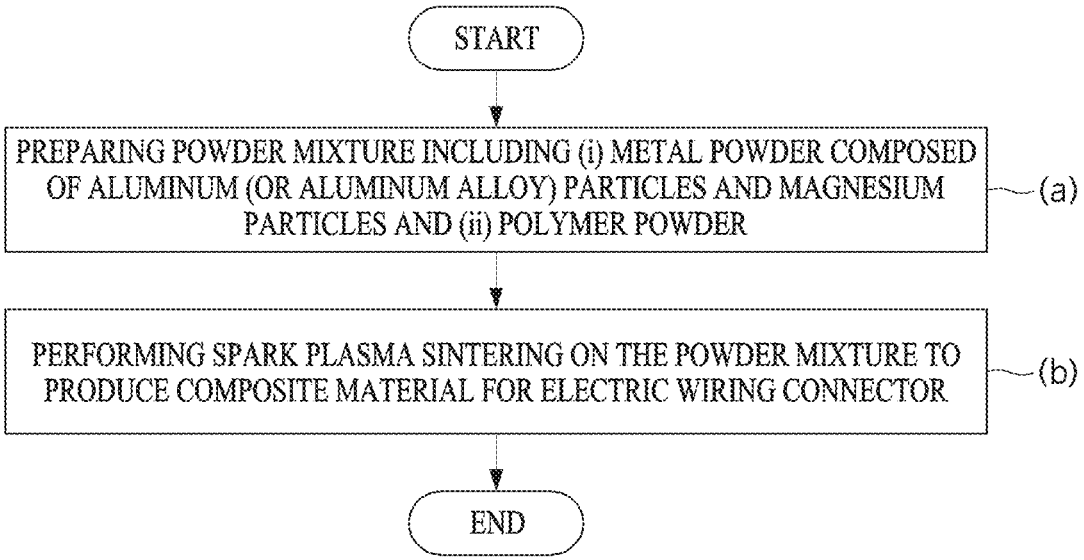
FIG. 2 is a process flow diagram illustrating a method of preparing a composite material for an electric wiring connector, according to one embodiment of the present invention.

A method of preparing a composite material for an electric wiring connector, according to one embodiment of the present invention, includes: (a) preparing a powder mixture including (i) a metal powder composed of aluminum or aluminum alloy particles and magnesium particles and (ii) a polymer powder; and (b) sintering the powder mixture prepared in the step (a) using a spark plasma sintering process to produce a composite powder (refer to FIG. 2).

In the step (a), electric ball milling, stirring ball milling, planetary ball milling, or the like is used to uniformly blend the polymer powder and the metal powder composed of aluminum or aluminum alloy particles and magnesium particles. The polymer powder functions to impart insulating property to the composite material. In an exemplary case, the powder mixture is prepared through a low energy milling process in which an electric ball mill is used and the milling is performed at a speed of 100 to 500 rpm for 1 hour to 24 hours.

The aluminum alloy particles included in the metal powder are prepared from any one or more alloys selected from the group consisting of aluminum alloys of 1000 series, 2000 series, 3000 series, 4000 series, 5000 series, 6000 series, 7000 series and 8000.

The polymer powder that is added to impart insulating property to the composite material is a thermoplastic resin or a thermosetting resin.

Examples of the thermoplastic resin include olefin resins (for example, polyethylene, polypropylene, poly-4-methylpentene-1), acrylic resins (for example, methyl polymethacrylate, and acrylonitrile), vinyl resins (for example, polyvinyl chloride, polyvinyl acetate, polyvinyl alcohol, poly Vinyl butyral, and polyvinyl chloride), styrene resins (for example, polystyrene and ABS resin), fluorine resins (for example, tetrafluoroethylene resin, trifluoroethylene resin, polyvinyl fluoride, and polyvinyl fluoride), cellulose resins (for example, nitrocellulose, cellulose acetate, ethyl cellulose, and propylene cellulose). In addition, polyamide, polyamideimide, polyacetal, polycarbonate, polyethylene butyrate, polybutylene butyrate, ionomer resin, polysulfone, polyethersulfone, polyphenylene ether, polyphenylene sulfide, polyetherimide, polyether ether ketones, aromatic polyesters (Ekonol and polyarylates), or the like can be used as the thermoplastic resin.

In addition, examples of the thermosetting resin include phenol resin, epoxy resin, and polyimide resin.

The composition of the powder mixture prepared in the step (a) is not particularly limited. The mixing ratio of the metal powder and the polymer powder is selected depending on the physical properties required for a composite material to be used to manufacture a final product (i.e., electrical wiring connector). Preferably, in the powder mixture, a volume fraction of the metal powder ranges from 30% to 85% and a volume fraction of the polymer powder ranges from 15% to 70%.

In addition, a ceramic powder can be optionally included in the powder mixture to control the dielectric constant and/or the mechanical properties. The ceramic powder is prepared from an insulating oxide ceramic material or a non-oxide ceramic material.

Examples of the oxide ceramic material include $Al_2O_3$, $SiO_2$, $TiO_2$, $Y_2O_3$, $ZrO_2$, $Ta_2O_5$, $ThO_2$, $ZrSiO_2$, BeO, $CeO_2$, $Cr_2O_3$, $HfO_2$, $La_2O_3$, MgO, and $Nb_2O_3$.

The non-oxide ceramic material is selected from among nitrides, carbides, and silicides. Examples of the nitride include AlN, GaN, InN, BN, $Be_3N_2$, $Cr_2N$, HfN, MoN, NbN, $Si_3N_4$, TaN, $Ta_2N$, $Th_2N_3$, TiN, $WN_2$, $W_2N$, VN, and ZrN. Examples of the carbide include $B_4C$, $Cr_3C_2$, HfC, $LaC_2$, $Mo_2C$, $Nb_2C$, SiC, $Ta_2C$, $ThC_3$, TiC, $W_2C$, WC, $V_2C$, and ZrC. Examples of the silicide include $CrSi_2$, $Cr_2Si$, HfSi, $MoSi_2$, $NbSi_2$, $TaSi_2$, $Ta_5Si_3$, $ThSi_2$, $Ti_5Si_3$, $WSi_2$, $W_5Si_3$, $V_3Si$, and $ZrSi_2$.

In the step (b), in order to produce a composite material for an electric wiring connector, the powder mixture is sintered using a spark plasma sintering process.

In the spark plasma sintering process, a pulsed direct current is applied to the powder mixture that may be shaped into a specific form under pressure. During the application of the pulsed direct current, sparks occur in the powder mixture due to the pulsed direct current flowing through the powder mixture. The powder mixture is sintered due to heat diffusion and field electric diffusion caused by high energy of spark plasma, heating of a mold induced by an electric resistance, the pressure, and electric energy. Thus, the metal powder and the polymer powder are combined together in a short time, thereby producing a highly compacted composite material. By this method, it is possible to effectively control the growth of grains of the composite material, thereby producing a finely-structured composite material suitable as a material for an electric wiring connector.

The spark plasma sintering used in the preparation method according to the present invention is performed using a spark plasma sintering apparatus including: a chamber having an internal space to accommodate a mold in which an upper electrode and a lower electrode are provided to generate spark plasma to sinter the powder mixture when current is supplied across the upper and lower electrodes; a cooling unit through which cooling water circulates to cool down the chamber; a current supply unit supplying current across the upper and lower electrodes; a temperature sensor configured to detect the temperature of the chamber; a pump configured to purge inside air from the chamber; a pressure unit to increase the internal pressure of the chamber; a controller to adjust a process temperature for spark plasma sintering according to the temperature detected by the temperature sensor; and a control board with which settings for the controller are made.

The pump of the spark plasma apparatus is operated to purge the inside of the chamber until the inside of the chamber enters a vacuum state. Through this purging, impurities in the chamber are completely removed. Therefore, the plasma spark sintering can be performed without causing oxidation.

The powder mixture is preheated to a predetermined sintering temperature at a predetermined heating rate, and then the spark plasma sintering is performed. Since the entire powder mixture in the chamber is uniformly heated through the preheating, it is possible to produce a homogeneous composite material.

In addition, since it is possible to inhibit the growth of grains of the composite material by adjusting the heating rate, it is possible to produce a composite material having a suitable grain size for an electric wiring connector.

For example, in the case of preparing a composite material from a powder mixture containing a polymer powder and a metal powder composed of aluminum or aluminum alloy particles and magnesium particles, the spark plasma sintering is performed at a temperature of 200° C. to 400° C. under a pressure of 5 MPa to 500 MPa for a period of 1 minute to 10 minutes. With these conditions, it is possible to produce a composite material for an electric wiring connector.

In addition, the preparation method may optionally further include a step of cooling the composite material resulting from the sintering process. With this cooling step, it is possible to improve the mechanical properties of the composite material so as to be more suitably used to manufacture an electric wiring connector. During the cooling step, a predetermined pressure is maintained to suppress formation of voids on the surface of or in the composite material.

According to the present invention, the method of manufacturing a composite material for an electric wiring connector involves a step of performing spark plasma sintering on a powder mixture composed of an electrically insulating polymer powder and a metal powder that contains aluminum or aluminum alloy particles and magnesium particles. Therefore, it is possible to obtain a material for an electric wiring connector that is highly heat-dissipative and durable with the use of the composite material.

In addition, the electrical wiring connector made of the metal-matrix polymer composite produced by the preparation method according to the present invention has a high dielectric constant and a high heat dissipation property. Therefore, the electric wiring connector can efficiently dissipate heat even when it is used for a high-voltage wire for a long period time. That is, safety and lifespan of the electric wiring connector are improved.

Hereinafter, the present invention will be described in more detail with reference to examples.

The examples disclosed herein may be modified in various other forms, and thus it should not be interpreted that the scope of the present invention is limited to the examples described below. The examples of the present invention are provided to more fully and thoroughly convey the concept of the present invention to those skilled in the art.

Example

A composite material for an electric wiring connector was prepared by obtaining a powder mixture containing a polymer powder and a metal powder composed of aluminum particles and magnesium particles and performing spark plasma sintering on the obtained powder mixture.

The metal powder was an aluminum-magnesium mixed powder in which a volume fraction of each of the aluminum and magnesium was 50%. The polymer powder was made of polyarylate (PAR) resin.

The polyarylate resin means aromatic linear polyester resin which is a plastic engineering resin with special properties. Since polyarylate resin is highly heat-resistive, mechanically strong, and transparent, it is used to manufacture switches of electronic components, sockets, parts of microwave ovens, casings of relays, substrates, and the like. In addition, in the field of machinery, polyarylate resin is widely used as a packaging material or a material for various articles such as interior/exterior products for watches, optical machinery parts, heating device parts such as gas circuit breakers, lenses and housings for automobiles, automotive parts, and instrument panels. The polyarylate resin as described above is usually prepared by condensation polymerization of an aromatic diol and an aromatic dicarboxylic acid.

First, AlSium powder and PAR powder were charged into a plurality of stainless steel vials in which a volume fraction ratio of the AlSium powder and the PAR powder varies from vial to vial. The volume fraction ratios for the respective vials were 85:15, 80:20, 75:25, 70:30, and 65:35. Then, 20 mL heptane was introduced into each of the vials. Stainless steel balls with a diameter of 10 mm are added. A weight ratio of the stainless steel balls and the powder mixture was 5:1. Next, low-energy ball milling was performed at a speed of 160 rpm for 24 hours. Thus, five metal-polymer powder mixtures that differ in volume fraction ratio of the metal powder and the polymer powder were prepared. That is, AlSium-15 vol. % PAR, AlSium-20 vol. % PAR, AlSium-25 vol. % PAR, AlSium-30 vol. % PAR, and AlSium-35 vol. % PAR were prepared.

Figure 3:
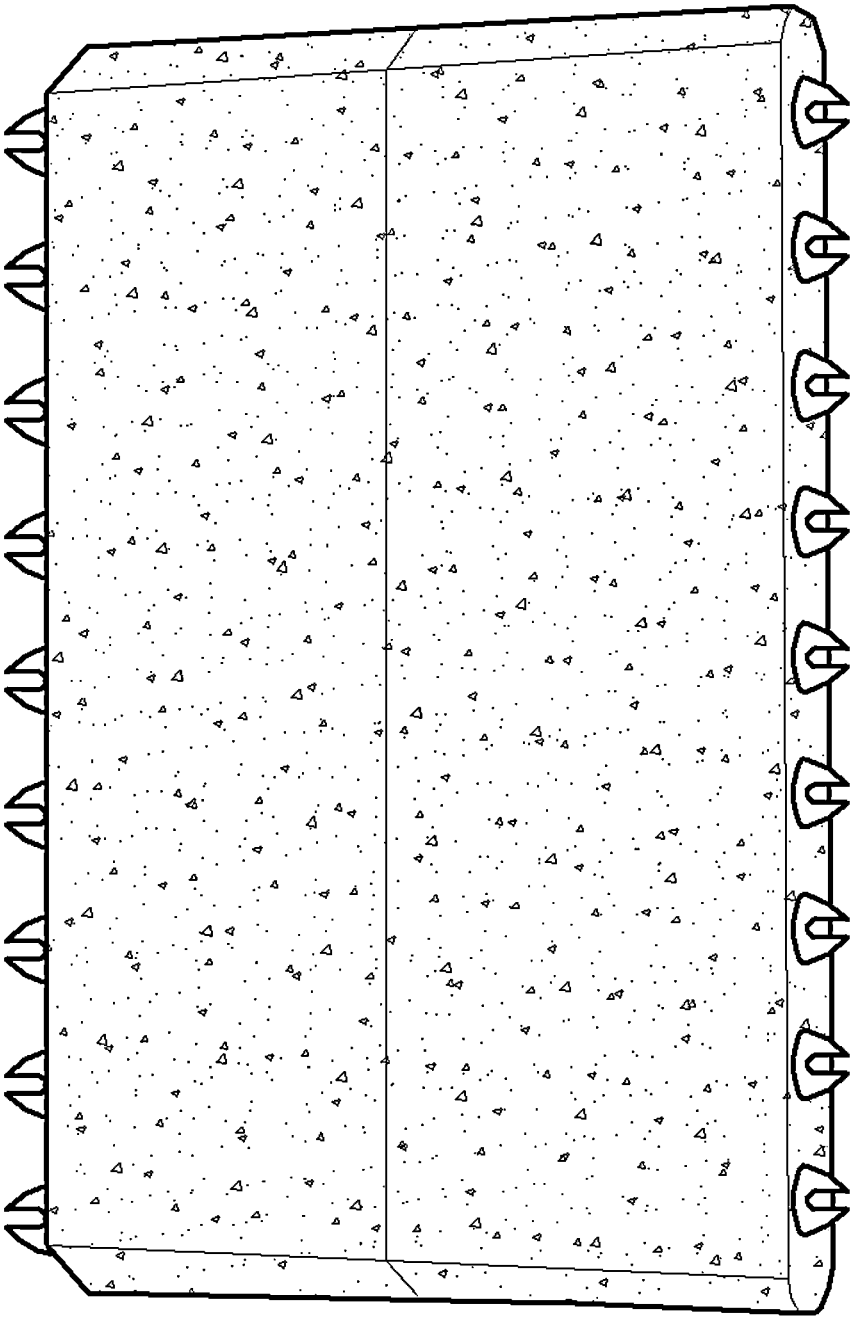
FIG. 3 is a photograph showing a spring-pin connector including an insulating housing made of a composite material produced through a preparation method according to one embodiment of the present invention.

Next, the metal-polymer powder mixture was poured into a tungsten carbide alloy (WC—Co) mold coated with boron nitride (BN) and heated to a sintering temperature of 330° C. at a heating rate of 50° C. per minute. Spark plasma sintering was performed at 330° C. under a pressure of 250 MPa for 5 minutes to produce a composite material for an electric wiring connector. Next, a spring-pin connector with a housing made of the composite material is manufactured for a PCB (refer to FIG. 3).

Specific embodiments and examples of the present invention have been described above with reference to the accompanying drawings, but those ordinarily skilled in the art will appreciate that the present invention can be implemented in other forms without departing from the technical spirit or essential features of the present invention. Therefore, it should be understood that the embodiments and examples described above are illustrative in all respects and are not restrictive.

What is claimed is:

1. A method of preparing a composite material for an electric wiring connector, the method comprising:

preparing two or more powder mixtures, each powder mixture including: (i) a metal powder comprising magnesium particles and aluminum or aluminum alloy particles, and (ii) a polymer powder comprising a polymer, wherein a fraction ratio of the polymer in each of the powder mixtures differs;

preparing a functionally graded laminate by sequentially laminating a plurality of powder mixture layers, wherein a content ratio of the polymer powder with respect to the metal powder gradually varies from a bottom powder mixture layer to a top powder mixture layer; and sintering the functionally graded laminate to produce a functionally graded composite material using a spark plasma sintering process.

2. The method according to claim 1, wherein the powder mixtures further include a ceramic powder.

3. The method according to claim 2, wherein the ceramic powder is made of one or more compounds selected from the group consisting of MgO, SiO2, Al2O3, AlN, or Si3N4.

4. The method of claim 1, wherein the spark plasma sintering process is performed under a pressure in a range of 5 MPa to 500 MPa.

5. The method of claim 4, wherein the spark sintering process is performed under a pressure in a range of 250 MPa to 500 MPa.

6. A method of manufacturing an electric wiring connector, the method comprising:

preparing two or more powder mixtures, each powder mixture including: (i) a metal powder comprising magnesium particles and aluminum or aluminum alloy particles, and (ii) a polymer powder comprising a polymer, wherein a fraction ratio of the polymer in each of the powder mixtures differs;

preparing a functionally graded laminate by sequentially laminating a plurality of powder mixture layers, wherein a content ratio of the polymer powder with respect to the metal powder gradually varies from a bottom powder mixture layer to a top powder mixture layer;

sintering the functionally graded laminate to produce a functionally graded composite material using a spark plasma sintering process; and forming a connector housing of the electric wiring connector with the functionally graded composite material.

* * * * *